United States Patent [19]

Pfaffenbichler et al.

[11] Patent Number: 5,029,890

[45] Date of Patent: Jul. 9, 1991

[54] SAFETY SKI BINDING

[75] Inventors: Peter Pfaffenbichler; Tibor Szasz, both of Vienna, Austria

[73] Assignee: TMC Corporation, Baar, Switzerland

[21] Appl. No.: 377,859

[22] PCT Filed: Oct. 20, 1988

[86] PCT No.: PCT/EP88/00941

§ 371 Date: Jul. 6, 1989

§ 102(e) Date: Jul. 6, 1989

[87] PCT Pub. No.: WO89/03711

PCT Pub. Date: May 5, 1989

[30] Foreign Application Priority Data

Oct. 22, 1987 [AT] Austria ..... 2796/87
Oct. 10, 1988 [AT] Austria ..... 2573/88

[51] Int. Cl.[5] ..... A63C 9/08

[52] U.S. Cl. ..... 280/613; 280/617; 280/634

[58] Field of Search ..... 280/617, 618, 611, 612, 280/613, 623, 624, 634, 14.2

[56] References Cited

U.S. PATENT DOCUMENTS 3,764,155 10/1973 Perrgman ..... 280/618
4,652,007 3/1987 Dennis ..... 280/618
4,741,550 5/1988 Dennis ..... 280/14.2
4,792,155 12/1988 Besnier ..... 280/14.2

FOREIGN PATENT DOCUMENTS 2595256 9/1987 France .
467081 2/1969 Switzerland .

*Primary Examiner*—Andres Kashnikow
*Assistant Examiner*—Richard Camby
*Attorney, Agent, or Firm*—Finnegan, Henderson, Farabow, Garrett & Dunner

[57] ABSTRACT

A safety ski binding for a sports item, the binding including first and second units, each unit for retaining a ski shoe therein, each unit comprising a holder for holding a ski shoe in a predetermined position and including a toe part and a heel part, a part of the holder being movable between a locked position for holding a ski shoe in the predetermined position and an unlocked position for releasing a ski shoe from the predetermined position. An unlocking device is provided for unlocking the holder to thereby release a ski shoe from the predetermined position, the unlocking device including a movable locking pin for selectively engaging a part of the holder. A releasing device is connected to at least one of the toe part and the heel part for releasing a ski shoe from the predetermined position when the holder is in the locked position, the releasing device for releasing a ski shoe in response to a force exerted thereon through the ski shoe. A connecting cable is provided for connecting the locking pin to the releasing device of the other of the first and second units to unlock the holder when a ski shoe held in the other of the first and second units is released from the releasing device.

17 Claims, 6 Drawing Sheets

SAFETY SKI BINDING

BACKGROUND OF THE INVENTION

The invention relates to a safety ski binding for a sports item, such as a snowboard, snow-gliding device or monoski,

DESCRIPTION OF THE RELATED ART

In the case of a safety binding of this type for a snowboard, known from U.S. Pat. No. 4,652,007, the binding units are connected via coupling parts which are only in interlocking engagement with the latter, which give rise to problems in conjunction with board flexure, can be dangerous in the case of release as freely movable parts and, above all, have the disadvantage that the release characteristic of the binding units cannot be set individually.

In the case of a snow-gliding device according to German Utility Model 8,105,142, the supporting board on which the binding units are fitted is mounted by means of flexible coupling parts on two ski elements or skids arranged one behind the other, as a result of which the user can control movements relative to the ski-run during the descent. On its upper side, the supporting board bears holding means for ski boots, which are designed in the form of straps, but which do not ensure a defined position of the ski boots on the supporting board. In addition, in the event of a fall of the user, there is the danger of one ski boot hanging in the strap, and thus on the supporting board, as a result of which injuries may occur.

A similar type of fastening of the two ski boots, although in this case on a monoski, is described in U.S. Pat. No. 4,403,785. In the case of this design, the two straps can be adjusted along guide rails, which are arranged on the upper side of the monoski.

EU-A 20147753 shows a monoski with two safety bindings. Here too, there is the risk of the one ski boot remaining in the ski binding when the other ski boot comes free, as a result of which—since such a ski is voluminous, in contrast to skiing on two separate skis—the danger of self-inflicted injury is increased.

The invention has set itself the object of avoiding these disadvantages and of creating a safety binding for sports items of the type mentioned at the beginning which makes it possible to set the release characteristic of the binding units in such a way that, if extraordinary forces occur, a reliable release of both of the user's ski boots or a detachment of the same from the sports item is ensured. In particular, it is to be ensured that, on release of the one ski boot, the other ski boot is also inevitably released.

This object is achieved according to the invention by providing a device wherein. In this, the control for the joint release of the two binding units is the same, the only difference being in the design of the sports item and in the use or non-use of a supporting plate.

The designs according to the invention make possible a free flexure of the sports item during descent, since the coupling parts are frictionally interconnected and thus relative movements between the sports item and its holding means can take place without neutralizing the holding forces for the ski boot. Due to the fact that both the dimensions and the pretensions of the springs for the holding means can be changed within broad limits, furthermore a good adaptation of the ski binding to the desired release values can be brought about. Since, after release of one of the ski boots or of one of the supporting plates by the one binding unit, the other ski boot or the other supporting plate is likewise released from the other binding unit by forced control (automatically), it is virtually impossible for the user to remain hanging on the sports item and thus the danger of injury is reduced considerably. Moreover, the stepping-in with the ski boots or supporting plates and the renewed fastening of the same at the binding units is simplified by the design according to the invention.

A preferred embodiment of the invention is defined by the features of claim 3. In this way, on the one hand a secure retention of the ski boot or of the supporting plate on the item is ensured and on the other hand—when the one ski boot or the one supporting plate comes free from the item—an immediate release of the other ski boot or of the other supporting plate is brought about in a simple way.

The inventor also ensures a compact design of the safety binding with use of supporting plates, since the latter surrounds the binding units in the manner of a frame.

The invention also provides a flexible connection between the holding pin of the one binding unit and the locking pin of the other binding unit, respectively. This measure also has the effect of ensuring that the two binding units are not confined to any design-dependent positions.

The invention also serves to facilitate voluntary stepping-out of the skier from the sports item and on the other hand of solving the regeneration of the system in a simple way.

The features of claim 7 make possible a space-saving arrangement of the design according to the invention of a binding on monoski.

If the ski boot is provided with a fitting for detachable connection to the holding pin, the features of claim 8 have the effect of avoiding the occurrence of undesired force components causing friction. As a result, it is prevented that harmful bending moments in a tripping-over fall of the skier are transferred to the shin.

The invention also make it particularly simple to secure the heel part of the ski boot. The arrangement of a cam-shaped supporting element as heel holding unit for a ski boot in the case of a safety ski binding designed with a pivotable release plate is admittedly known per se from U.S. Pat. No. 3,764,155. The present invention makes possible a space-saving design of the heel part on a sports item.

An automatic resetting of the base plate into its initial position is also ensured by an embodiment of the invention.

BRIEF OF DESCRIPTION OF THE DRAWINGS

The invention is explained in more detail below by several exemplary embodiments, with reference to the drawings.

FIG. 1 shows a partially sectioned plan view of a first embodiment of the binding according to the invention, FIG. 2 is a cross-sectional view taken along the line II—II in FIG. 1, and FIG. 3 is a cross section view taken along the line III—III in FIG. 1, FIG. 4 is a partially sectioned plan view of a second embodiment of a binding according to the invention.

FIG. 4*a* a detail of the plan view FIG. 4 in an enlarged scale,

Figure 5:
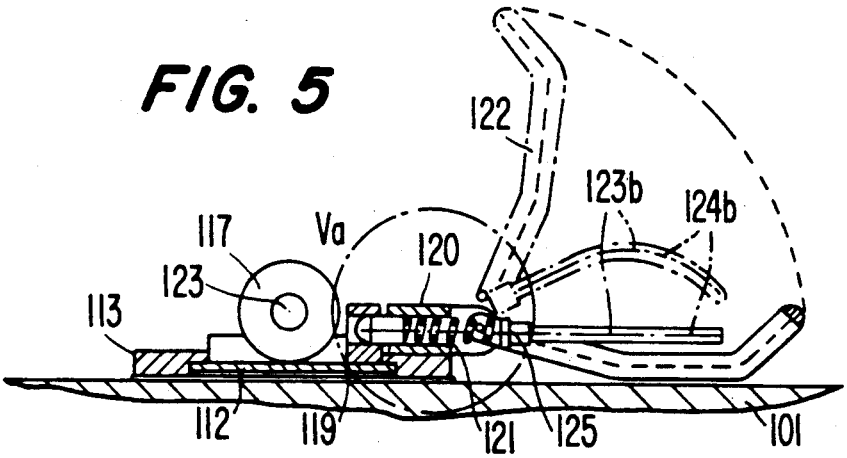
FIG. 5 is a cross sectional result taken along the line V—V in FIG. 4.
Figure 6:
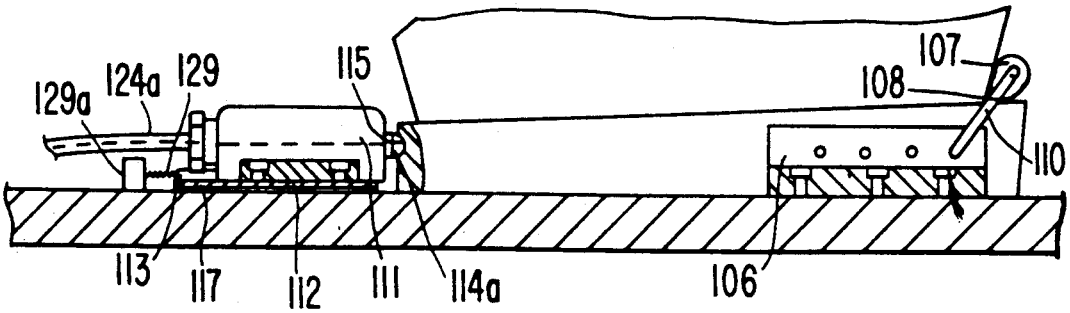
FIG. 6 is a cross-sectional view taken along the line VI—VI in FIG. 4.
Figure 7:
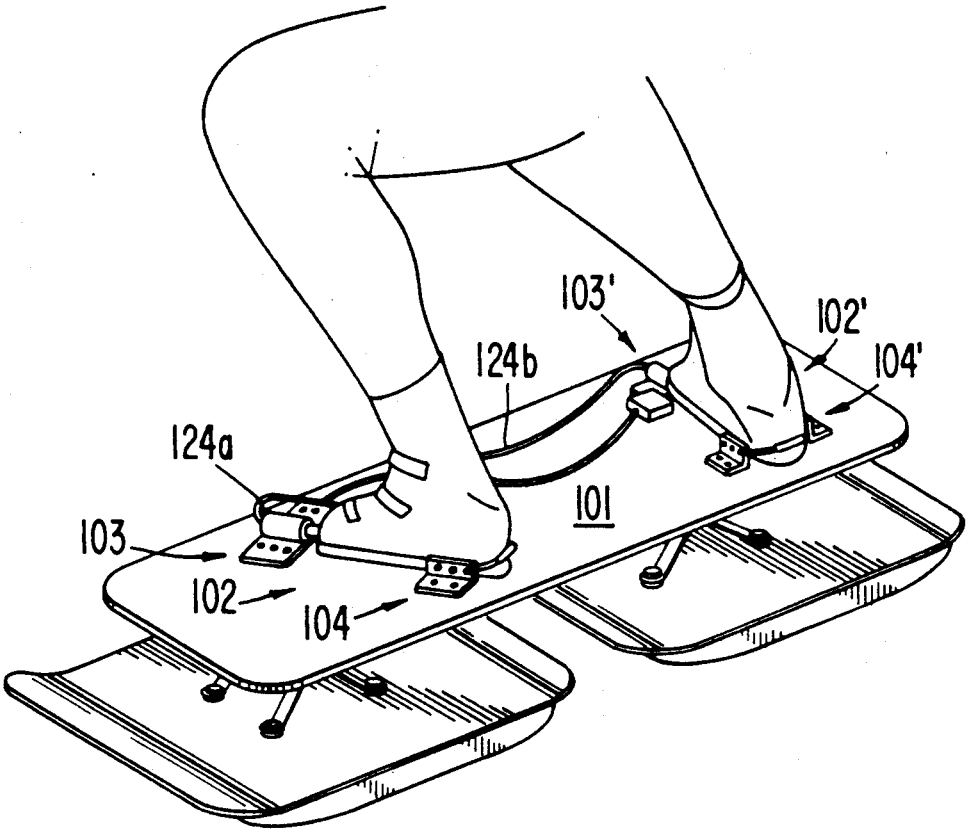
Figure 9:
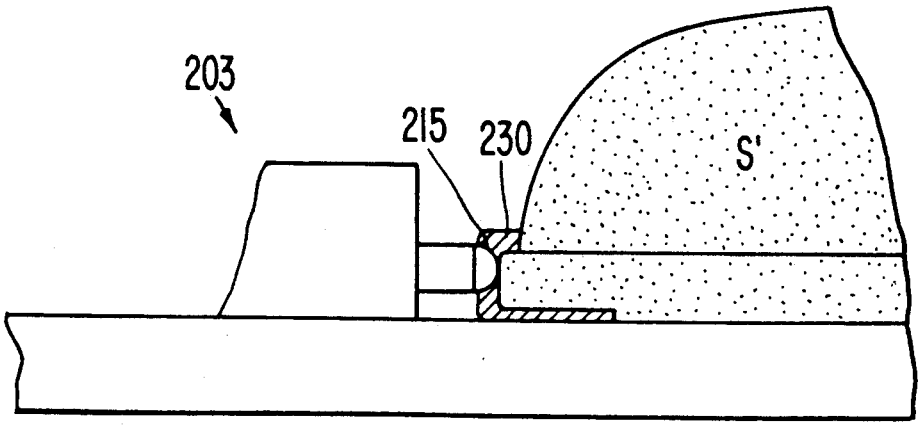
Figure 8:
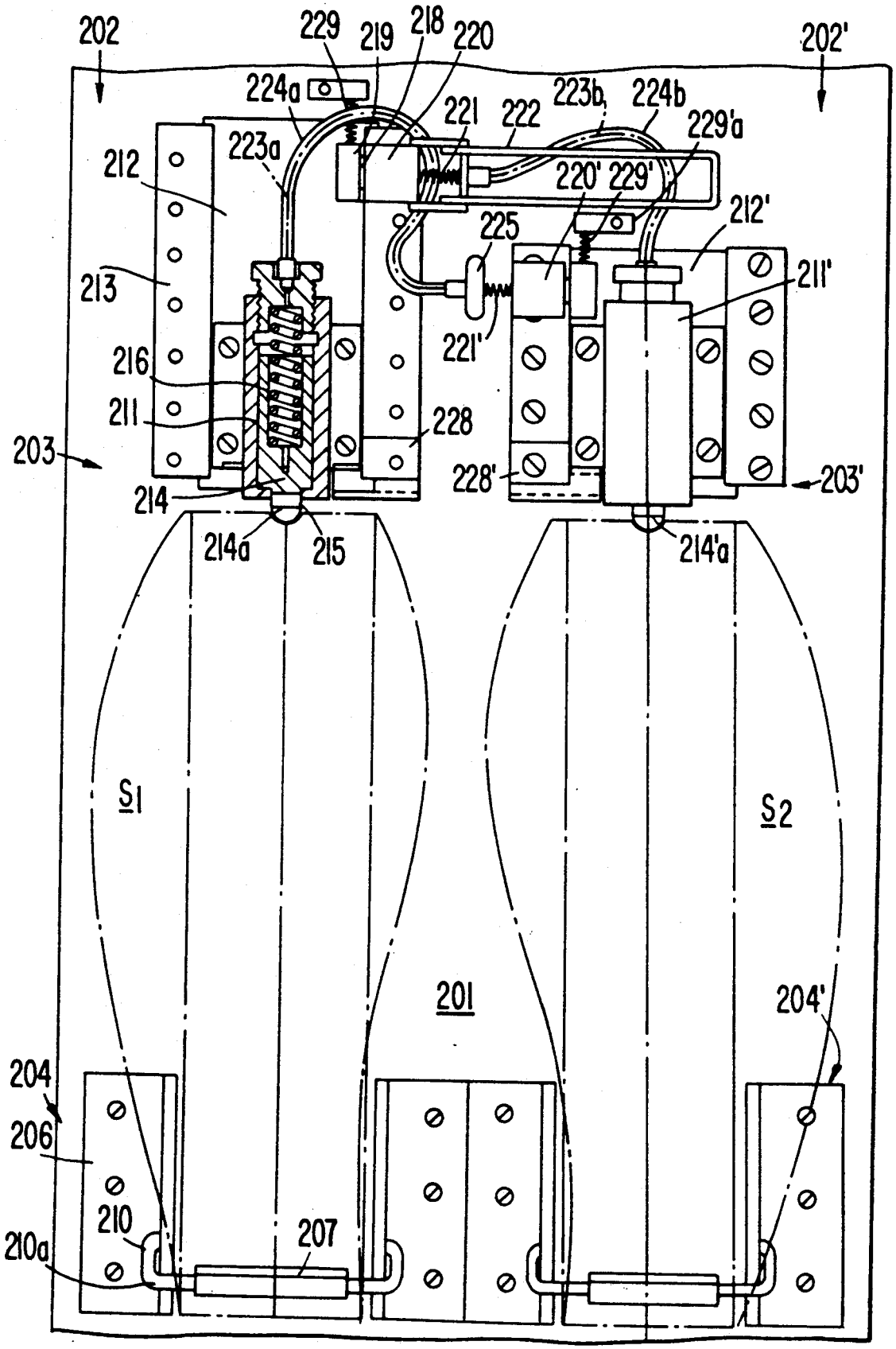

In FIG. 7, shows a snow-gliding device fitted, with the safety binding depicted in FIGS. 1, 4 to 6 is represented as a diagram, FIG. 8 shows a third embodiment of the safety binding according to the invention in an arrangement on a monoski in partially sectioned plan view, FIG. 9 depicts a variant of the connection region of the ski boot in partially sectioned elevation in accordance with the invention.

DETAILED DESCRIPTION OF THE PREFERRED EMBODIMENTS

Figure 1:
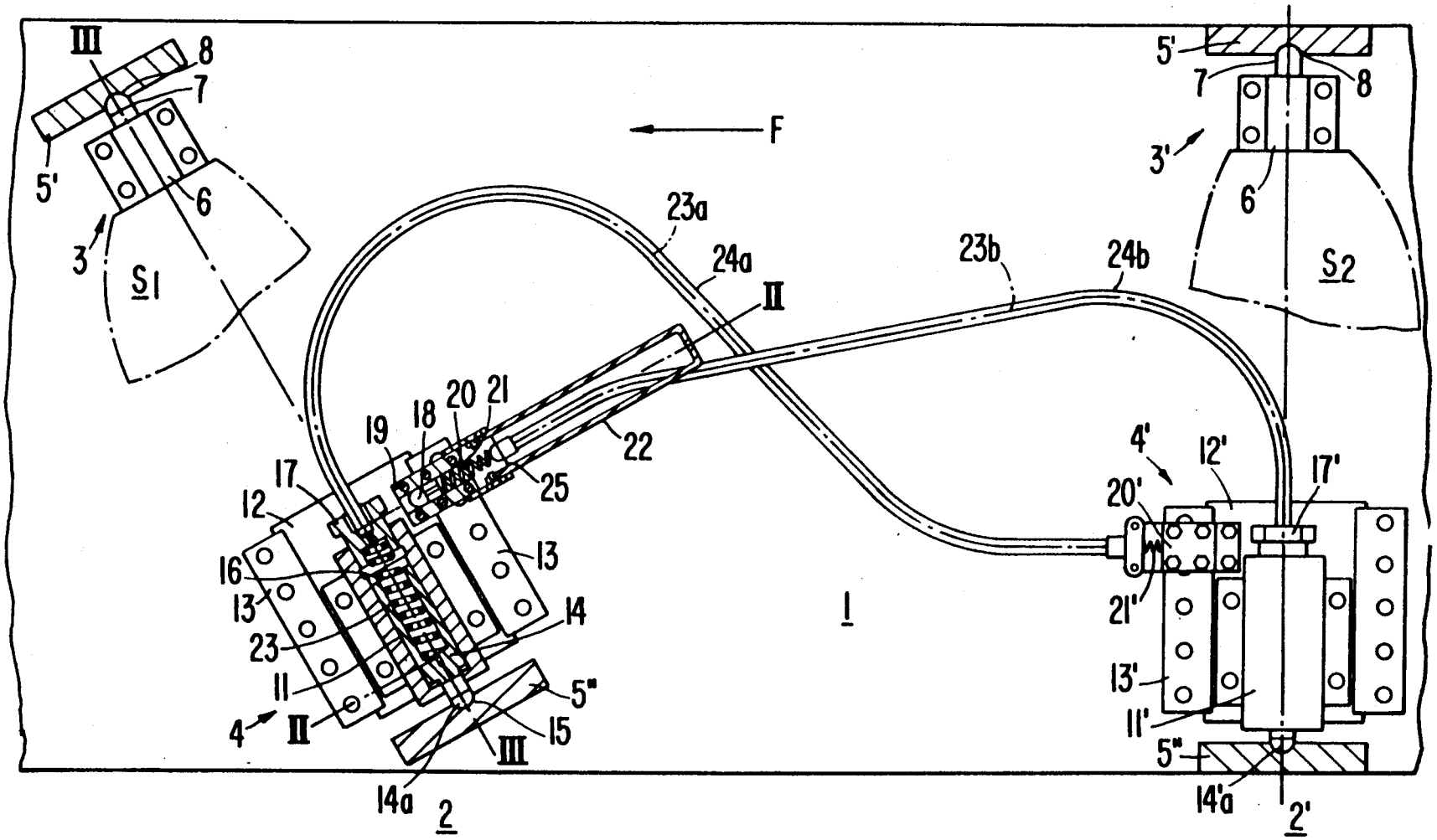

A binding according to the invention, as in the first exemplary embodiment, is mounted on the upper side of a snowboard 1, as in FIG. 1. The binding consists of two essentially identically designed units 2,2', which are assigned to the two ski boots $S_1$, $S_2$ of the user and, as to be explained in more detail, are mechanically in connection with each other.

Each unit 2 and 2' comprises a toe part 3 and 3', respectively, a heel part 4 and 4', respectively, and a supporting plate 5, in engagement with these parts, for the ski boot $S_1$. As FIG. 1 shows, the front unit 2, in running direction (arrow F), is arranged obliquely to the longitudinal axis of the snowboard 1, whereas the rear unit 2' is transverse, essentially normal, to this longitudinal axis.

The toe part 3 and 3', respectively, of each unit is formed by a front housing 6, mounted on the snowboard 1, for a stationary holding pin 7, the free-standing end region of which is rounded off and is in engagement with an essentially conical recess 8 in a vertical limb 5' of the supporting plate 5. In lateral receiving points of the supporting plates 5, which are not designated any more specifically, a front swivel bow 9 and a rear clamping fixture 10 are detachably articulated, which serve as clamping means for the fixing of the ski boot $S_1$ on the upper side of the supporting plate 5. Such clamping means, which also make possible an adaptation to ski boot soles of different lengths, are known to a person skilled in the art both with regard to design and with respect to handling and do not constitute any subject of the invention.

The heel part 4 has a housing 11 which is not however, unlike the front housing 6, firmly connected to the snowboard 1, but is held with its baseplate 12 by two L-shaped angles 13, which are fastened on the snowboard 1 and act as a type of guide rail, and can be displaced in the direction of the axis of symmetry x—x running between heel part 4 and toe part 3. Displaceably arranged in the housing 11 is a plunger 14, which protrudes on the side remote from the toe part 3 from the housing 11 with its rounded-off end, designed as holding pin 14a, and, like the holding pin 7, is in engagement with an essentially conical recess 15 in the other vertical limb 5" of the supporting plate 5. The holding pin 14a is held in the engagement position via the plunger 14 by a compression spring 16, which engages with one end in a cylindrical bore of the plunger 14 and is seated with the other end in a threaded bush 17 which is screwed into the housing 11 and with which the spring pretension can be set. As FIG. 1 shows, the length of the supporting plate 5 and the pretension of the compression spring 16 are chosen such that, in the engagement position of the supporting plate 5, the holding pin 14a is pushed against the force of the compression spring 16 into the housing 11.

The housing 11 and its baseplate 12 are held in the shown engagement position of the supporting plate 5 by a cylindrical locking pin 18, which has a rounded-off head, serves as locking means and engages in a pin guide 19 which is mounted on the baseplate 12 and runs transversely to the direction of movement of the baseplate 12. The locking pin 18 is guided in a spring housing 20, which is mounted on one of the L-shaped angle profiles 13 and is pretensioned into the engagement position by a tension spring 21. The tension spring 21 is supported on a spring seat 25, which is connected, as described in more detail further below, to a tension lever 22, which can be swung toward the upper side of the snowboard 1 and away from it.

The plunger of the holding pin 14a is connected via a first Bowden cable, the wire 23a of which is guided in a tube 24a, to the locking pin, not visible here, of the rear binding unit 2'. In the same way, the plunger of the holding pin 14'a of this binding unit 2' is connected to the locking pin 18 of the front binding unit 2 via a second Bowden cable, the wire 23b of which is likewise guided in a tube 24b.

If, during operation, for example the front ski boot $S_1$ is overloaded in one direction or the other, the one and/or the other vertical limb 5', 5" of the supporting plate 5 comes out of engagement from the toe part 3 and/or heel part 4 of the binding unit 2. The holding pin 14a is then moved under the action of the compression spring 16 up to its stop on the inside of the end wall of the housing 11. As a result, the wire 23a of the Bowden cable 23a, 24a, connected to this holding pin 14a, exerts a pulling action on the locking pin, not visible in FIG. 1, of the rear binding unit 2', the baseplate 12' of which is thus released with the housing 11' for the plunger with the holding pin 14'a, which has as a consequence a relative movement of the baseplate 12' together with housing 11' and a detachment of the supporting plate 5 also of this unit 2' from the heel part 4. The travel of the plunger 14 out of the position shown in FIG. 1 up to the stop on the inside of the end wall of the housing 11 is large enough that the locking pin of the rear binding unit 2' comes out of engagement from the assigned baseplate 12' far enough that the head of the locking pin can, during a movement of the baseplate 12', be pushed back from the same.

As is evident from FIG. 1, the tension spring 21' for the locking pin of the rear binding unit 2' is supported on a spring seat 25', firmly connected to the housing 20'. Thus, there is no tension lever provided in the case of the unit 2'.

After a detachment of the two supporting plates 5 from the binding units 2,2', the regeneration of the entire system is necessary for renewed stepping-in. First of all, before putting the supporting plate 5 in place, the baseplate 12, pushed as far as a stop (not shown here), for example provided on the snowboard, is brought manually into the position represented in FIG. 1, in which the locking pin 18 engages in the pin guide 19 initially with its rounded-off head, for centering purposes. Thereafter, the tension lever 22, articulated at the housing 20, is swung up from the snowboard 1, which has a movement of the locking pin 18 into the final locking position as a consequence.

This adjustment is made possible by the fact that, with the swinging-up of the tension lever 22, the entire Bowden cable 23*b*, 24*b*, fastened on the spring seat 25, is swung along with it, and the distance which brought about the pull of the cable 23*b* upon release of the second supporting plate 5 at the rear holding bolt 14'*a* again, so that the locking pin 18 is brought into the engagement position via the tension spring 21. The front supporting plate 5 can then be inserted into the front binding unit 2.

The entry with the front supporting plate 5 has the effect of pushing the holding bolt 14*a* back against the force of the compression spring 16. In this case, the pulling action of the cable 23*a* on the locking pin of the rear binding unit 2' is neutralized and this locking pin is again pretensioned into the engagement position by its tension spring 21' and pressed into the baseplate 12', likewise brought into the engagement position in the way already explained, of the rear binding unit 2'. Thereafter, the supporting plate 5 of the rear binding unit 2' is clipped into the latter. The cable 23*b* connected to the assigned plunger of the holding pin 14'*a* thereby becomes tension-free. In order to reestablish the tension of the cable 23*b*, passing freely movably through the tension lever 22, necessary for a predetermined release of the binding, the tension lever 22 is swung into the lower end position shown in FIG. 2 on the upper side of the snowboard 1.

Figure 4:
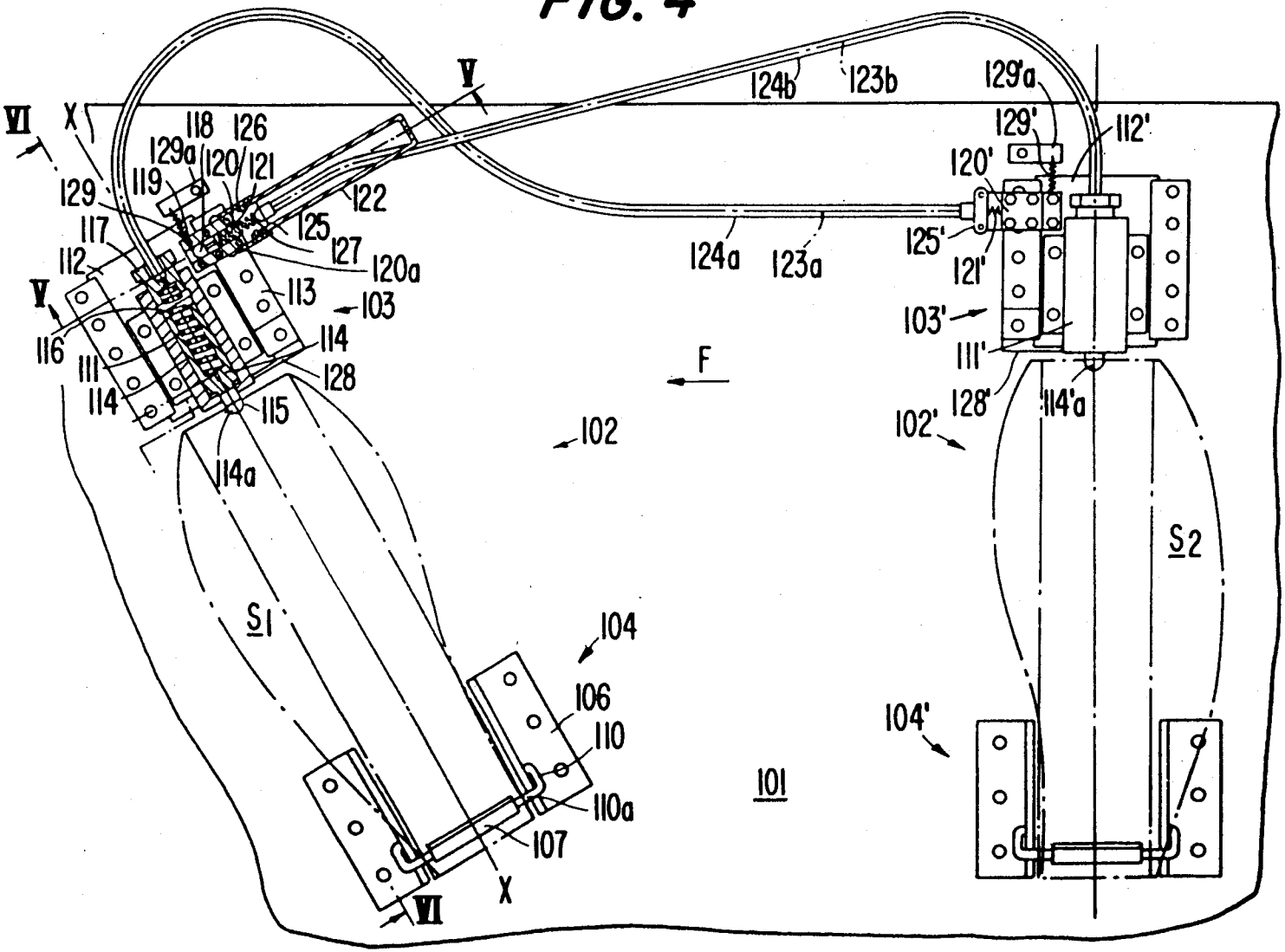
Figure 5A:
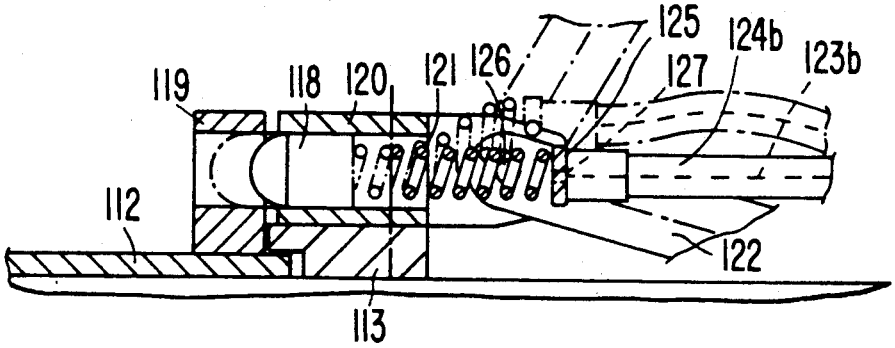
FIG. 5a is a detailed view of FIG. 5 on an enlarged scale.

In FIGS. 4 to 7, a variant of the safety binding according to the invention with ski boots is illustrated as a second exemplary embodiment. In this case, the safety binding represented in FIGS. 4–6 is mounted on the upper side of an item 101, designed as a snow-gliding device (cf. FIG. 7). The binding consists of two essentially identically designed units 102 and 102', which are assigned to the two ski boots $S_1$ and $S_2$ of the user and are mechanically in connection with each other, as will be explained with reference to FIGS. 4 to 6.

Each unit 102 and 102' comprises a toe part 103 and 103', respectively, and a heel part 104 and 104', respectively, into which parts the respective ski boots $S_1$ and $S_2$ can be inserted. As FIG. 4 shows, the front unit 102, in running direction (arrow F), is arranged obliquely, the rear unit 102 on the other hand transversely to the running direction.

The heel part 104, 104' of each unit 102, 102' is formed by a U-shaped holding bow 110, which is pivotably mounted in a rail 106 fixed to the ski. This rail 106 is formed by two angle irons, which are fastened by one limb to the item 101. In the upwardly protruding limbs of the angle irons there are several holes made in pairs, into which the angled-off ends of the holding bow 110 can be hooked, according to choice, in order to be able to bring about an adaptation of the heel part 104, 104' to the size of the ski boot $S_1$ and $S_2$, respectively, used. The crosspiece 110*a* of the holding bow 110 bears a cam-shaped supporting member 107, which in the running position of the safety binding engages in a groove 108 of the heel of the ski boot $S_1$ and $S_2$, respectively.

For the sake of simplicity, only the toe part 103 of the one binding unit 102 is described in more detail below.

Figure 4A:
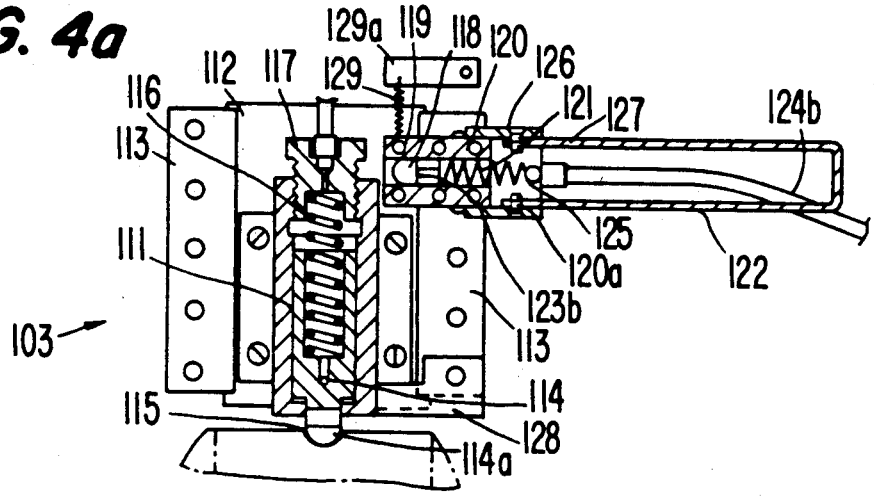

The toe part 103 has a housing 111, which is held with its baseplate 112 by two L-shaped angle profiles 113, fastened on the snow-gliding device 101, and is guided displaceably in the direction of the axis of symmetry x—x running between the toe part 103 and the heel part 104. Arranged displaceably in the housing 111 is a plunger 114, which is designed as holding means and bears on the side facing the heel part 104 a holding pin 114*a*, which protrudes with a rounded-off end out of the housing 111 and which is in engagement with an essentially conical recess 115 in the ski boot $S_1$. The holding pin 114*a* is held in the engagement position by a compression spring 116, which engages with one end in a cylindrical blind bore of the plunger 114 and is seated with the other end in a threaded bush 117, which is screwed into the housing 111 and by which the spring pretension can be set. As FIGS. 4 and 4*a* show respectively, the pretension of the compression spring 116 is chosen such that, in the engagement position with the ski boot $S_1$, the holding pin 114*a* is pushed somewhat against the force of the compression spring 116 into the housing 111.

In the engagement position shown, the housing 111 and its baseplate 112 are held in position by a cylindrical locking pin 118, having a rounded-off head and serving as locking means. The locking pin 118 engages in a pin guide 119, which is mounted on one of the baseplate 112 and runs transversely to the direction of movement of the baseplate 112. The locking pin 118 is guided in a spring housing 120, which is mounted on one of the L-shaped angle profiles 113 and is pretensioned into the engagement position by a tension spring 121. The tension spring 121 is supported on a spring seat 125, which is articulatedly mounted on a tension lever 122, which can be swung toward the snow-gliding device 101 and away from it.

The tension lever 122 is mounted pivotably by means of a pivot spindle 126 in a normal plane to the binding unit 102 in a U-shaped bow 120*a* on the spring housing 120 and bears the spring seat 125 on a spindle 127 which runs parallel to the pivot spindle 126 of the tension lever 122.

The plunger 114 of the first binding unit 102 is connected via a first Bowden cable, the wire or cable 123*a* of which is guided in a tube 124*a*, to the locking pin, not visible here, of the rear binding unit 102'. In the same way, the plunger of the holding pin 114'*a* of this binding unit 102' is connected to the locking pin 118 of the first binding unit 102 via a second Bowden cable, the wire or cable 123*b* of which is likewise guided in a tube 124*b*.

If, during operation, for example the front ski boot $S_1$ is overloaded in one direction or the other, it comes out of engagement with its sole from the toe part 103 and/or heel part 104 of the binding unit 102. The holding pin 114*a* is then moved under the action of the compression spring 116 up to its stop on the inside of the end wall of the housing 111. The cable 123*a* of the Bowden cable 123*a*, 124*a*, connected to this holding pin 114*a*, exerts a pulling action on the locking pin of the rear binding unit 102', the baseplate 112' of which is thus released with the housing 111' for the plunger with the holding pin 114'*a*, which has as a consequence a relative movement of the baseplate 112' together with housing 111' and a detachment of the ski boot $S_2$ from the toe part 103'. The travel of the holding pin 114*a* out of the position shown in FIG. 1 up to the stop on the inside of the end wall of the housing 111 is large enough that the locking pin of the rear binding unit 102' comes out of engagement from the assigned baseplate 112' far enough that the head of the locking pin can, during a movement of the baseplate 112', be pushed back from the same.

As evident from FIG. 4, the tension spring 121' for the locking pin of the rear binding unit 102' is supported on a spring seat 125', firmly connected to the housing 120'. Thus, there is no tension lever provided in the case of the unit 102'.

After a detachment of the two ski boots $S_1$ and $S_2$ binding units 102, 102', the regeneration of the entire system is necessary for renewed stepping-in. First of all, before putting the ski boot $S_1$ in place, the baseplate 112, pushed as far as a stop 128, for example provided on an angle profile 113 of the snow-gliding device 111, under the influence of a restoring spring 129 supported on an abutment 129*a* fixed to the ski, is brought into the position represented in FIG. 4, in which the locking pin 118 engages in the pin guide 119 with its rounded-off head, for centering purposes. Thereafter, the tension lever 122, articulated at the housing 120, is swung up from the snow-gliding device 101, which has a movement of the locking pin 118 into the final locking position as a consequence.

This adjustment is made possible by the fact that, with the swinging-up of the tension lever 122, the entire Bowden cable 123*b*, 124*b*, fastened on the spring seat 125, is swung along with it, and the distance which brought about the pull of the cable 123*b* upon release of the second ski boot $S_2$ at the rear holding bolt 114'*a* is eliminated again, so that the locking pin 118 is brought into the engagement position via the tension spring 121. The ski boot $S_1$ can then be inserted into the front binding unit 102 (cf. in particular FIG. 5*a*).

The entry with the front ski boot $S_1$ has the effect of pushing the holding bolt 114*a* back against force of the compression spring 116. In this case, the pulling action of the cable 123*a* on the locking pin of the rear binding unit 102' is neutralized and this locking pin is again pretensioned into the engagement position by its tension spring 121' and pressed into the baseplate 112', brought into the engagement position by means of the restoring spring 129', of the rear binding unit 102'. Thereafter, the ski boot $S_2$ is inserted into the rear binding unit 102'. The cable 123*b* connected to the plunger of the holding pin 114'*a* thereby becomes tension-free.

In order to reestablish the tension of the cable 123*b*, passing freely movably through the tension lever 122, necessary for a predetermined release of the binding, the tension lever 122 is swung into the lower end position shown in FIG. 5 on the snow-gliding device 101.

The third embodiment represented in FIG. 8 shows a monoski 201 with a safety binding according to the invention. The latter likewise consists of two units 202 and 202', as have been described at length in conjunction with the second exemplary embodiment according to FIGS. 4–6.

The arrangement according to FIG. 8 differs from that described above in that both binding units 202 and 202, are fastened parallel to each other in longitudinal direction of the monoski 201 on the same. In this case, the two angle profiles 213 and the baseplate 212 of the first binding unit 202 are lengthened in relation to the second binding unit 202, of the ski boot $S_1$, in order to make possible a space-saving arrangement of the pin guide 219 and of the tension lever 222 with the spring housing 220. In the present exemplary embodiment, the visible components have been denoted with reference numerals of the 200 series.

According to FIG. 9, the ski boot S' is provided in its front end region with a fitting 230, in which an essentially conical recess 215 is made. The fastening of such fittings onto ski boots is known without further explanations for a person skilled in the art (cf. U.S. Pat. No. 2,616,714). The operating principle of this safety binding corresponds to that already described.

The exemplary embodiments explained above can be modified variously within the scope of the general idea of the invention. For instance, the tension lever may also be provided on the rear binding unit instead of on the front binding unit. In addition, the inclination of the binding units with respect to the longitudinal direction of the snow-gliding device may be changed if the binding units are mounted on baseplates or the like which are adjustable relative to the snow-gliding device. Furthermore, the function of toe part and heel part of each binding unit could be interchanged, i.e. the heel part could have the design represented instead of the toe part.

It is also conceivable to dimension the longitudinal movement of the cables of the two Bowden cables in such a way that the individual locking pins—acted upon by a tension spring each—merely align with the associated pin guides and a clipping-in or locking of the locking pins only takes place after release of the individual cables. This design has the advantage that the release of the ski boot takes place without overcoming relatively small additional forces.

Figure 2:
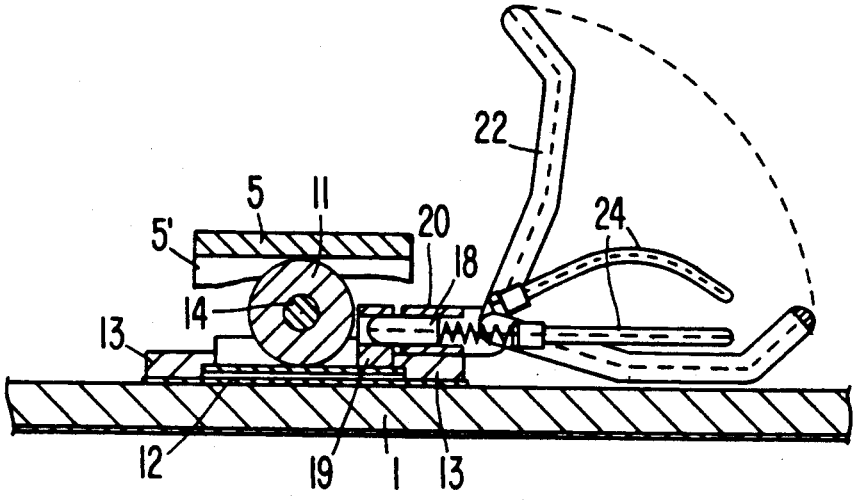
Figure 3:
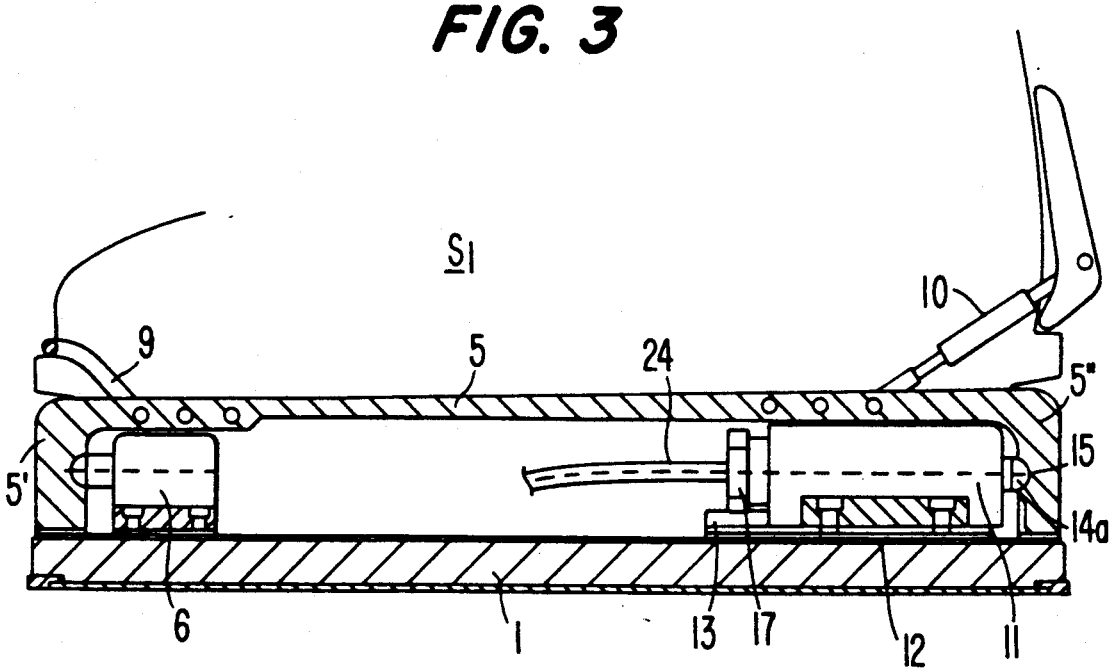

In order to reduce the friction on the underside of the baseplate, the individual binding units can also be mounted on the upper side of the sports item with an underlay plate interposed. Such an arrangement is indicated in FIGS. 2 and 5.

We claim:

1. A safety ski binding for a sports item, the binding including first and second units, each unit for retaining a ski shoe therein, each unit comprising:

holding means for holding a ski shoe in a predetermined position and including a toe part and a heel part, a part of said holding means being movable between a locked position for holding a ski shoe in said predetermined position and an unlocked position for releasing a ski shoe from said predetermined position;

means for unlocking said holding means to thereby release a ski shoe from: said predetermined position, said unlocking means including a movable locking pin for selectively engaging a part of said holding means;

releasing means, connected to at least one of said toe part and said heel part, for releasing a ski shoe from said predetermined position when said holding means is in said locked position, said releasing means releasing a ski shoe in response to a force exerted thereon;

connecting means including a bowden cable for connecting said locking pin to the releasing means of the other of said first and second units to unlock said holding means in the other of said first and second units when a ski shoe held in the other of said first and second units is released from its respective releasing means.

2. A safety ski binding as set forth in claim 1, wherein each unit further includes a support plate for attachment to a ski shoe, said support plate having at least one recess, said releasing means including a spring and a plunger, said plunger having said locking pin integrally formed on an end thereof and disposed within one of said toe part and said heel part, said spring for exerting a force on said plunger to urge said locking pin into engagement with said at least one recess of said support plate.

3. A safety ski binding as set forth in claim 1, wherein at least one of said toe holding part and said heel holding part is mounted on a slidable baseplate, said holding means including guide means for permitting said part mounted on said baseplate to slide between said locked position and said unlocked position, said locking pin being movable between a first position engaging said one of said toe part and said heel part to prevent sliding movement of said part mounted on said baseplate, and a second position permitting said sliding movement of said part mounted on said baseplate.

4. A safety ski binding as set forth in claim 3, wherein at least one of the first and second units includes a tension lever operatively connected to said locking pin, said lever being manually movable to thereby selectively move said locking pin between said first and second positions.

5. A safety ski binding as set forth in claim 4, further including a locking spring for urging said locking pin to said first position and a spring seat connected to said tension lever, said tension lever being pivotable to selectively urge said spring seat in directions toward and away from said locking spring.

6. A safety ski binding as set forth in claim 1, wherein one of said toe part and said heel part is mounted on a slidable base plate, and said holding means further includes first and second guide means disposed on opposite sides of said base plate for permitting said base plate to slide therebetween, said locking pin being disposed in a housing connected to one of said first and second guide means, and said first base plate including a pin receiving portion for receiving said pin when said holding means is in the locked position.

7. A safety ski binding for a sports item, the binding including first and second units, each unit for retaining a ski shoe therein, each unit comprising:

holding means for holding a ski shoe in a predetermined position and including a toe part and a heel part, a part of said holding means being movable between a locked position and an unlocked position;

a support plate for connection to a sole of a ski shoe, said support plate for engaging said holding means in said locked position to maintain the ski shoe in a predetermined position, said support plate being detachable from the sports item when said holding means is in said unlocked position;

means for unlocking said holding means from said locked position to release said support plate from said holding means;

releasing means, connected to one of said toe part and said heel part, for releasing engagement between said holding means and said support plate when said holding means is maintained in said locked position; and connecting means including a bowden cable for connecting said unlocking means to said releasing means of the other of said first and second units to unlock said holding means when a support plate of the other of said first and second units is released by the releasing means.

8. A safety ski binding as set forth in claim 7, wherein said support plate includes at least one recess and said releasing means includes a spring and a plunger each disposed within one of said toe part and said heel part, said spring for urging an end of said plunger to engage said at least one recess.

9. A safety ski binding as set forth in claim 7, further including a base plate and wherein said holding means includes first and second guide means, one of said toe part and said heel part being mounted on said base plate, said base plate being slidable between said guide means to move said part disposed thereon between said locked and unlocked positions, said unlocking means including a locking pin movably connected to one of said guide rails and a portion disposed on the base plate for receiving an end of said locking pin to maintain said part mounted on said base plate in said locked position when the end of said locking pin is disposed in said receiving portion.

10. A safety ski binding as set forth in claim 7, wherein said toe part and said heel part each include an outwardly projecting holding pin and said support plate has a substantially U-shaped cross-section including first and second downwardly projecting limbs, each limb including a recess for receiving a respective holding pin.

11. A safety ski binding as set forth in claim 10, wherein said release means includes one of said holding pins, said one of said holding pins being movable out of said recess to release engagement between said holding means and said support plate.

12. A safety ski binding as set forth in claim 11, wherein said holding pin of said release means is operatively connected through said connecting means to the unlocking means of the other of said first and second units.

13. A safety ski binding as set forth in claim 7, wherein one of the first and second units includes a tension lever operatively connected to said unlocking means for allowing a user to manually unlock said holding means.

14. A safety ski binding as set forth in claim 7, further including a tension lever operatively connected to said locking in through a locking spring, said tension lever being movable between a first position for transmitting a force on said locking position wherein said tension lever transmits substantially no force to said spring.

15. A safety ski binding as set forth in claim 14, wherein said tension lever is pivotally mounted on said unlocking means.

16. A safety ski binding as set forth in claim 9, wherein said unlocking means is mounted on one of said guide means.

17. A safety ski binding as set forth in claim 9, further including a restoring spring for urging the base plate and the part mounted thereon to said locked position.

* * * * *

UNITED STATES PATENT AND TRADEMARK OFFICE

CERTIFICATE OF CORRECTION

PATENT NO. : 5,029,890

DATED : July 9, 1991

INVENTOR(S) : Peter PFAFFENBICHLER et al.

It is certified that error appears in the above-identified patent and that said Letters Patent is hereby corrected as shown below:

Claim 1, column 8, line 42, after "from" delete ":" (the colon).

Claim 14, column 10, line 46, change "in" to --pin--.

Title page, after "Assignee:", change "Baar" to --Baar/Zug--.

Signed and Sealed this

Twentieth Day of October, 1992

*Attest:*

DOUGLAS B. COMER

*Attesting Officer*

*Acting Commissioner of Patents and Trademarks*